US011089868B1

(12) United States Patent
Livingston, Jr.

(10) Patent No.: US 11,089,868 B1
(45) Date of Patent: Aug. 17, 2021

(54) CHANNEL PUCK FOR USE IN A RAILED TABLE

(71) Applicant: Omni Cubed, Inc., Shingle Springs, CA (US)

(72) Inventor: Larry Leigh Livingston, Jr., Cameron Park, CA (US)

(73) Assignee: OMNI CUBED, INC., Shingle Springs, CA (US)

( * ) Notice: Subject to any disclaimer, the term of this patent is extended or adjusted under 35 U.S.C. 154(b) by 0 days.

(21) Appl. No.: 16/986,268

(22) Filed: Aug. 6, 2020

Related U.S. Application Data

(63) Continuation of application No. 29/744,474, filed on Jul. 29, 2020, and a continuation of application No. 16/939,001, filed on Jul. 26, 2020, now abandoned.

(51) Int. Cl.

| | |
|---|---|
| ***A47B 37/00*** | (2006.01) |
| ***A47B 1/08*** | (2006.01) |
| ***A47B 21/03*** | (2006.01) |
| ***A47B 1/10*** | (2006.01) |

(52) U.S. Cl.
CPC ..... *A47B 37/00* (2013.01); *A47B 1/08* (2013.01); *A47B 1/10* (2013.01); *A47B 21/03* (2013.01); *A47B 2200/0066* (2013.01); *A47B 2200/0085* (2013.01)

(58) Field of Classification Search
CPC .... A47B 37/00; A47B 1/10; A47B 2200/0066
USPC ..... 108/143, 20, 65, 50.17, 55.3
See application file for complete search history.

(56) References Cited

U.S. PATENT DOCUMENTS 4,051,787 A * 10/1977 Nishitani ..... B65D 19/0012 108/55.3
4,378,709 A * 4/1983 Chitayat ..... F16H 19/025 108/143
4,397,246 A * 8/1983 Ishida ..... B65D 19/0012 108/55.3
4,580,680 A * 4/1986 Wind ..... B65D 19/0018 108/55.3
4,604,226 A * 8/1986 Bartlett ..... C09K 3/30 252/389.21
4,729,536 A * 3/1988 Scala ..... B23Q 1/621 108/143
5,092,252 A * 3/1992 Gillhart ..... B65D 19/0028 108/53.1
5,341,751 A * 8/1994 Cuneo ..... B23Q 1/01 108/143
5,673,780 A * 10/1997 Bildsoe ..... B65G 13/10 108/55.3
5,823,084 A * 10/1998 Ramey ..... B25B 5/003 83/415

(Continued)

*Primary Examiner* — Jose V Chen
(74) *Attorney, Agent, or Firm* — Manuel F. de la Cerra

(57) ABSTRACT

A work table improvement for supporting and fabricating a solid surface is disclosed. The work table has a plurality of table rails, wherein each table rail has a rail top surface and a rail channel running along at least a portion of the rail length on the rail top surface. The table also includes a plurality of channel pucks comprised of a compressible material. Each channel puck has a puck top and a puck tongue, and the puck tongue further includes a necked region, a flared region, and a tapered region. The pucks are constructed to be installed into the rail channel in a direction that is substantially orthogonal to the rail top surface.

20 Claims, 16 Drawing Sheets

(56) References Cited

U.S. PATENT DOCUMENTS 5,937,924 A * 8/1999 Cooper ..... B25H 1/005
144/286.5
8,065,967 B2 * 11/2011 Wong ..... B25H 1/02
108/181
8,850,939 B2 * 10/2014 Patella ..... B27B 25/10
83/438

* cited by examiner (Locating Configuration)

(Active Installation Configuration)

(Passive Installation Configuration)

CHANNEL PUCK FOR USE IN A RAILED TABLE

1.0 CROSS-REFERENCE TO RELATED APPLICATIONS

This application claims priority as a continuation of U.S. patent application Ser. No. 16/939,001 filed on Jul. 26, 2020 entitled A CHANNEL PUCK FOR USE INA RAILED TABLE, and as a continuation of U.S. patent application Ser. No. 29/744,474 filed on Jul. 29, 2020 entitled A CHANNEL PUCK FOR USE IN A RAILED TABLE. The entire contents of these patent applications are incorporated by reference herein.

2.0 FIELD OF THE INVENTION

This invention relates to on-site support tables. More particularly, the invention relates to tables that may be used for the installation and fabrication of solid surfaces.

3.0 BACKGROUND

The demand for solid surface materials used in home and commercial construction such as granite, marble, engineered stone, acrylic, sintered stone, and large format porcelain have steadily risen over the past decade. As the demand for solid surface countertops, vanities, tub-decks, showers, fireplace mantels and hearths continue to grow, the more imperative it is for solid surface fabrication companies to do the work faster, safer, and without sacrificing quality, in order to meet demand.

Often the solid surface material is partially fabricated at a manufacturing facility and then transported to the installation site or be fitted and installed. The manufacturing facility may, for example, laminate two or more pieces of material together, especially at the visible edges of countertops. By laminating pieces together, it is possible to make the finished countertop appear thicker, and to provide a more substantial edge for the application of more elegant edge treatments.

On-site fitment may include cutting the edges of the material to account for improper measurements and/or flaws in the solid surface fabrication. Other on-site fitment issues include cutting holes in the material to account for sinks, cooktops, and electrical outlets. On-site lamination may also be required. Installers currently use collapsible tables that can be set-up on-site and that can evenly support (to keep the material from breaking) the weight of the solid surface work-piece. These tables however, do not provide clearance for unobstructed cutting, nor do they provide a non-slip surface, often requiring the installer to clamp the work-piece to the collapsible table.

What is needed, therefore, is a table-top system that provides a non-slip surface with clearance to allow for unobstructed and/or uninterrupted cutting.

4.0 SUMMARY

The present invention provides an elegant solution to the needs described above and offers numerous additional benefits and advantages, as will be apparent to persons of skill in the art. In one aspect, a work table improvement for supporting and fabricating a solid surface is disclosed. The work table has a plurality of table rails, wherein each table rail has a rail top surface and a rail channel running along at least a portion of the rail length on the rail top surface. The table also includes a plurality of channel pucks comprised of a compressible material. Each channel puck has a puck top and a puck tongue, and the puck tongue further includes a necked region, a flared region, and a tapered region. The pucks are constructed to be installed into the rail channel in a direction that is substantially orthogonal to the rail top surface.

The rail channel may include a side edge and a bottom edge, and the installation of the channel pucks may have at least three configurations: a locating configuration wherein the tapered region is at least partially in the rail channel; an active installation configuration wherein the flared region compresses against the rail side edge; and a passive installation configuration wherein (1) the flared region is decompressed relative to the active installation configuration, (2) the flared region abuts the rail bottom edge, and (3) the puck top abuts the rail top surface.

The channel puck compressible material may be a soft plastic or rubber, and may be slip resistant. The puck top may include a puck top surface constructed to contact a work piece, and when in the passive installation configuration, the puck top surface is elevated away from the rail top surface by an offset.

The rail channel may have a rail channel opening width and the puck tongue may have a longitudinal dimension that is wider than the rail channel opening width. The necked region may be narrower than the flared region. The tapered region may include a narrowed end that is narrower than the necked region. The rail channel may have a channel opening width that is narrower than the flared region.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

5.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. Furthermore, various features of different disclosed embodiments can be combined to form additional embodiments, which are part of this disclosure. It will be understood that certain components and details may not appear in the figures to assist in more clearly describing the invention.

6.0 DETAILED DESCRIPTION

Figure 1:
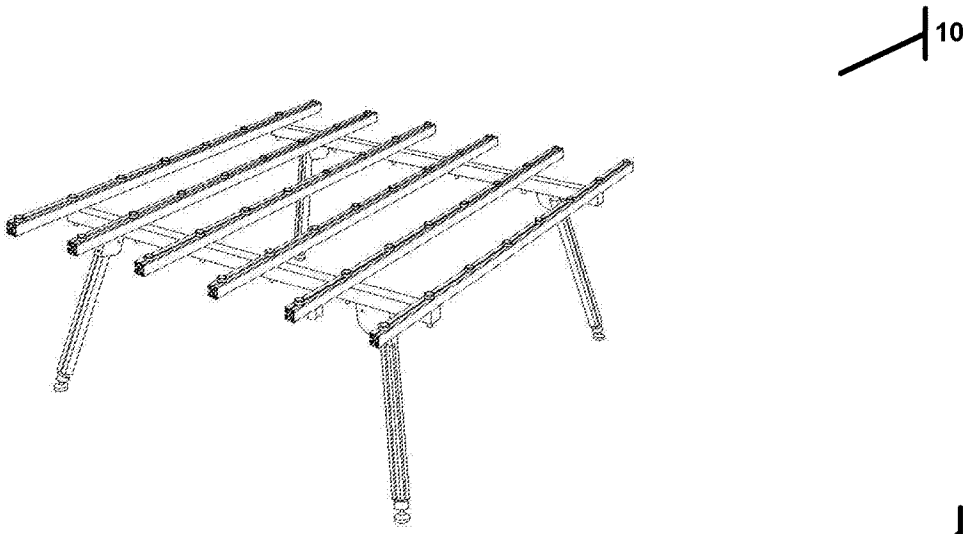
FIG. 1 is a top perspective view of a multi-rail work table with the channel pucks installed.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

The following list of example features corresponds with attached figures and is provided for ease of reference, where like reference numerals designate corresponding features throughout the specification and figures:

Work Table 10
Table Legs 12
Table Frame 14
Work Table Rail 15
Work Table Rail Top Surface 15A
Work Table Rail Length 15B
Rail Channel 20
Rail Channel Side Edge 20A
Rail Channel Bottom Edge 20B
Rail Channel Opening Width 20C
Channel Puck 25
Bump Stop 27
Work Piece 30
Resistance Against Sliding Force 35A,B
Offset 40
Power Tool 45
Puck Top 50
Top Surface 50A
Bottom Surface 50B
Puck Tongue 55
Puck Tongue Longitudinal Dimension 55A
Necked Region 60
Neck Region Width 60A
Flared Region 65
Flared Region Width 65A
Tapered Region 70
Narrowed End 70A
Narrowed End Width 70B
Installation Push Direction 75

Figure 2:
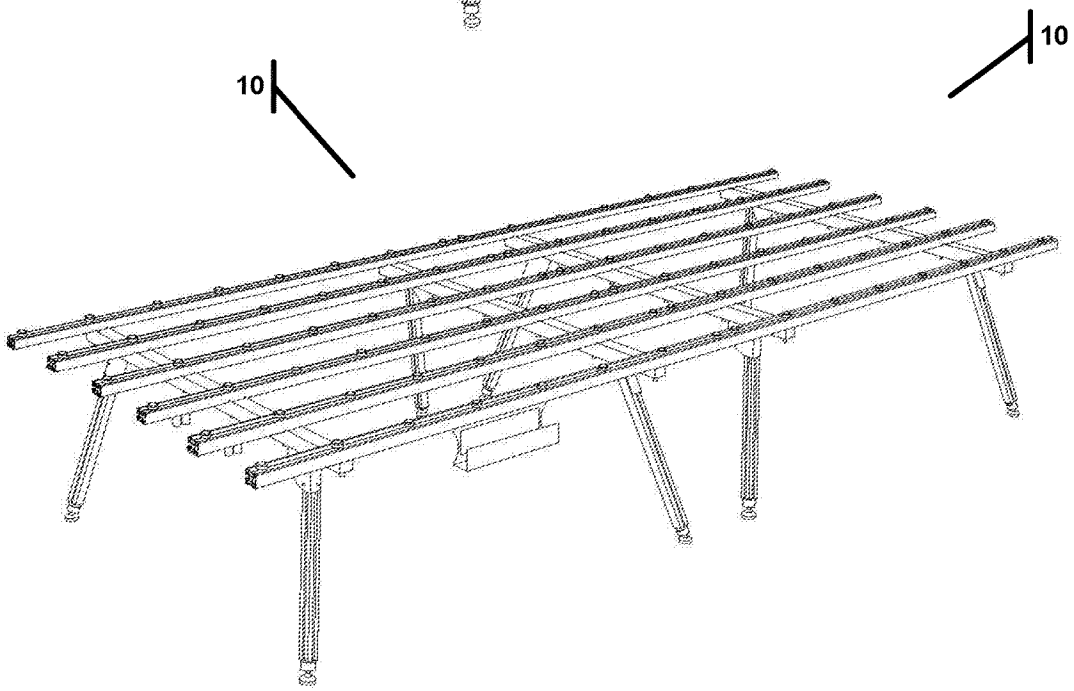
FIG. 2 is a top perspective view of a two multi-rail work tables, linked together, each with the channel pucks installed.
Figure 3:
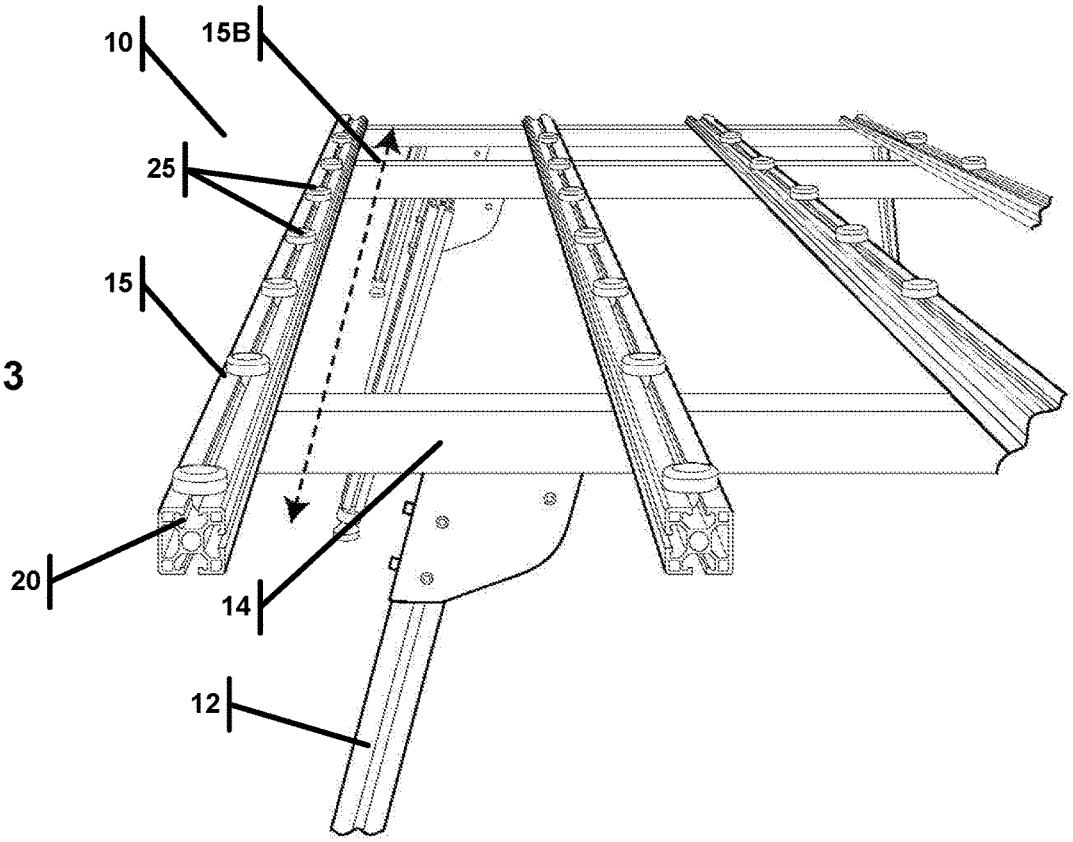
FIG. 3 is a side perspective close-up view of a multi-rail work table with the channel pucks installed.
Figure 4:
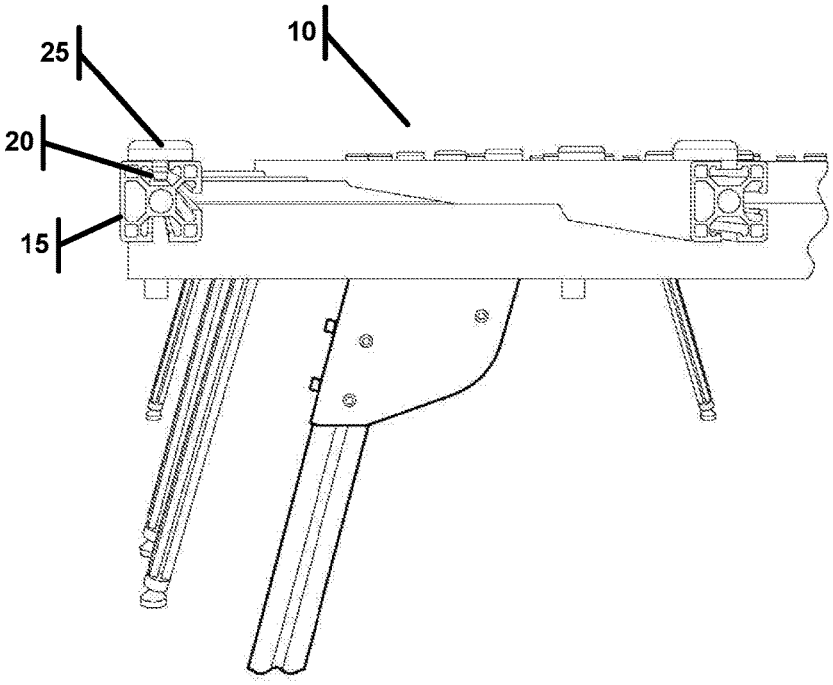
FIG. 4 is a side close-up view of a multi-rail work table with the channel pucks installed.
Figure 5:
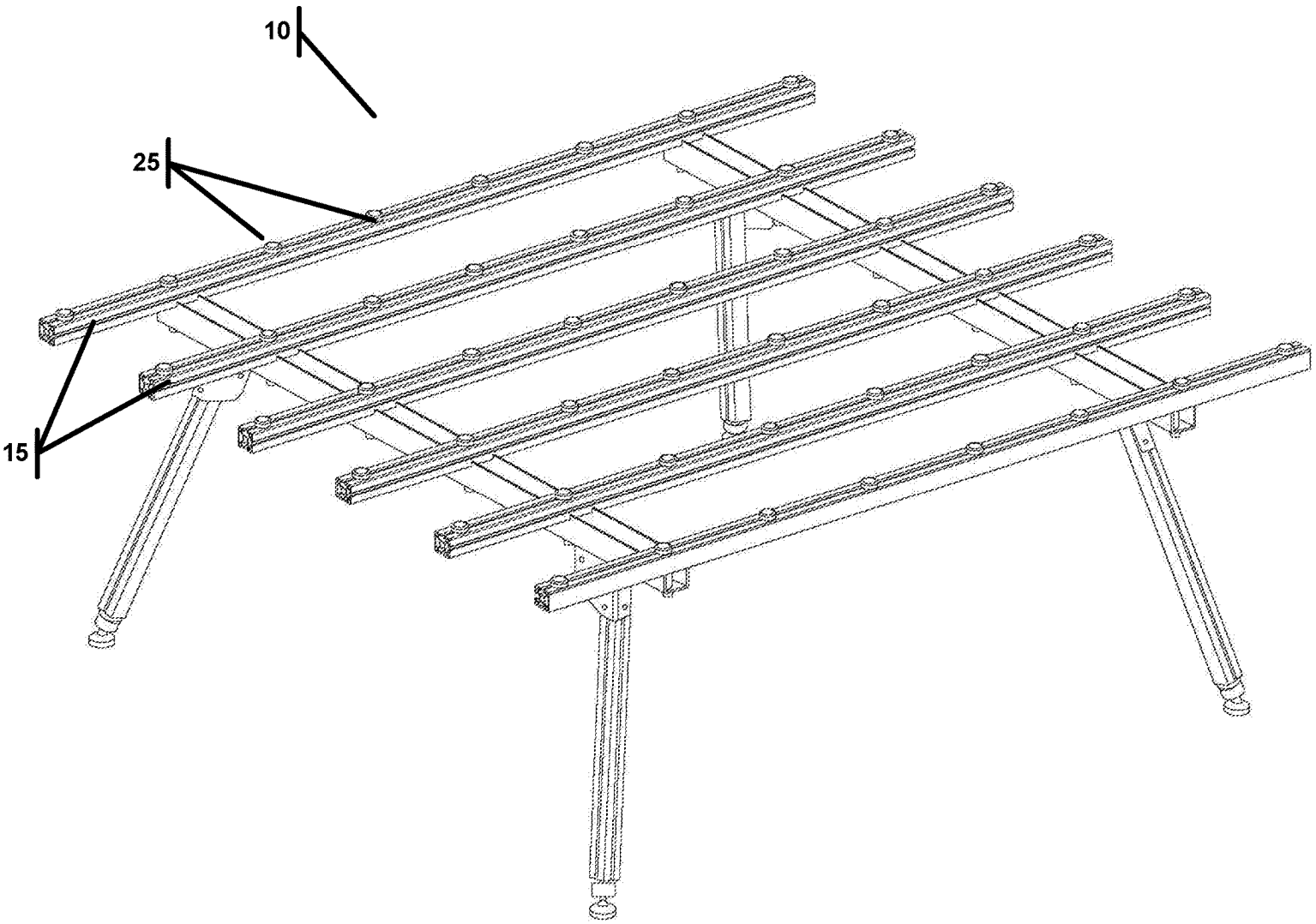
FIG. 5 is a top perspective view of a multi-rail work table with the channel pucks installed.
Figure 6:
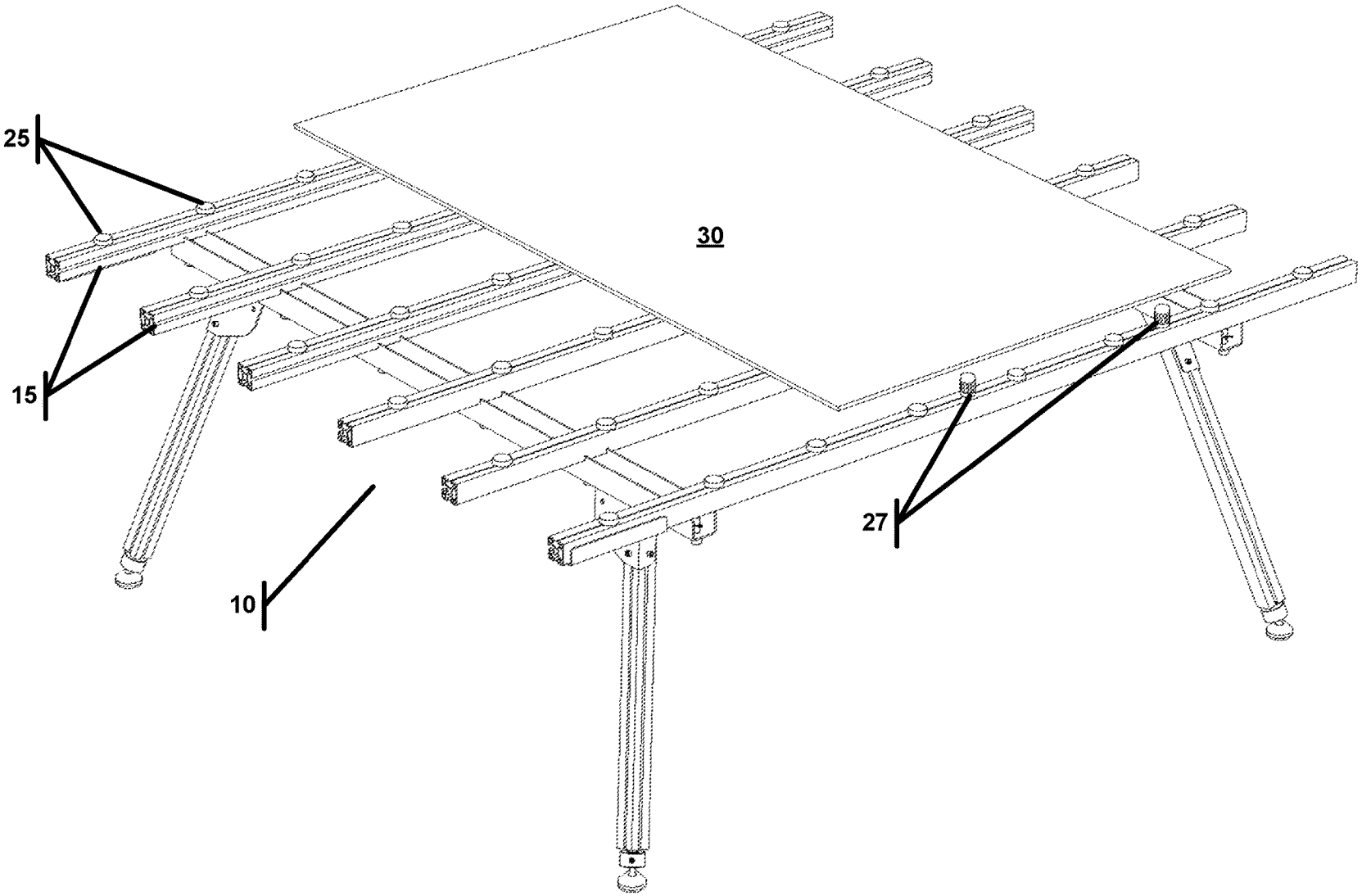
FIG. 6 is a top perspective view of a multi-rail work table with the channel pucks installed, supporting a work piece.

FIG. 1 illustrates a top perspective view of a multi-rail work table 10 with the channel pucks installed. FIG. 2 shows two such tables 10 linked together. FIGS. 3, 4 and 5 illustrate the work table 10, with table legs 12, connected to a table frame 14, upon which multiple rails 15 are mounted. Each table rail 15 has a rail top surface (15A, see FIG. 9) and a rail channel 20 running along at least a portion of the rail length 15B on the rail top surface 15A. Inserted into the rail channels 20 are a plurality of channel pucks 25. As shown in FIG. 6, work piece 30 may be placed on top of the table 10, supported by the top surface 50A of the channel pucks 25. Bump stops 27 may also be inserted into the rail channels 20 to restrict the movement of the work piece 30.

Figure 7:
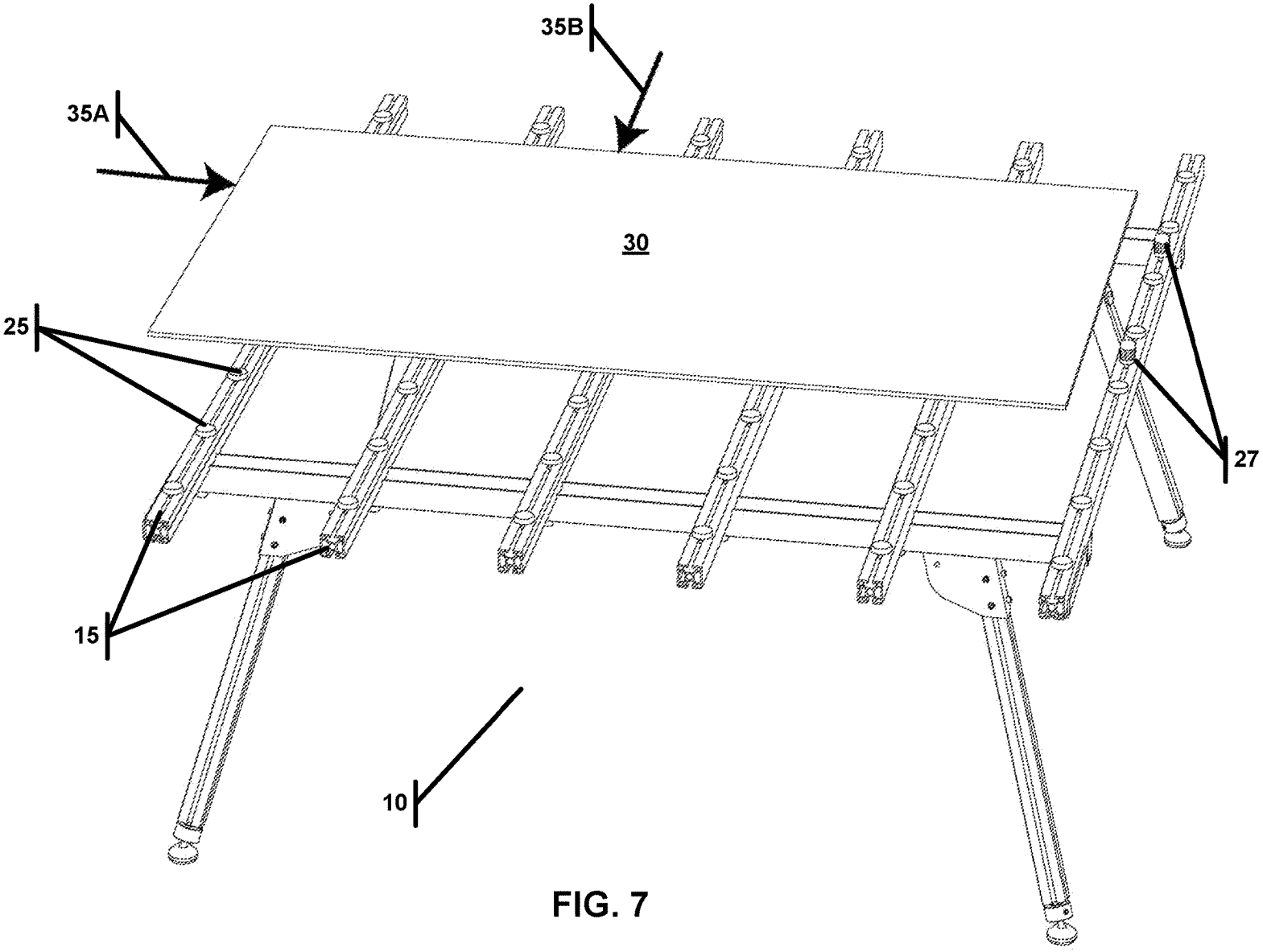
FIG. 7 is a top perspective view of a multi-rail work table with the channel pucks installed, supporting a work piece.

The channel pucks 25 are made of a semi-compressible material, such as a soft plastic or rubber, which provides a non-skid work surface that imparts a friction force on the work piece, providing a resistance against a sliding force, shown as arrows 35A and 35B in FIG. 7. This is an improvement of the prior art, which may use cardboard, or hard plastic, that slide along the metal rail. A user of the presently disclosed channel pucks may fabricate a work piece without the need of clamps or extra materials saving time and money.

Figure 8:
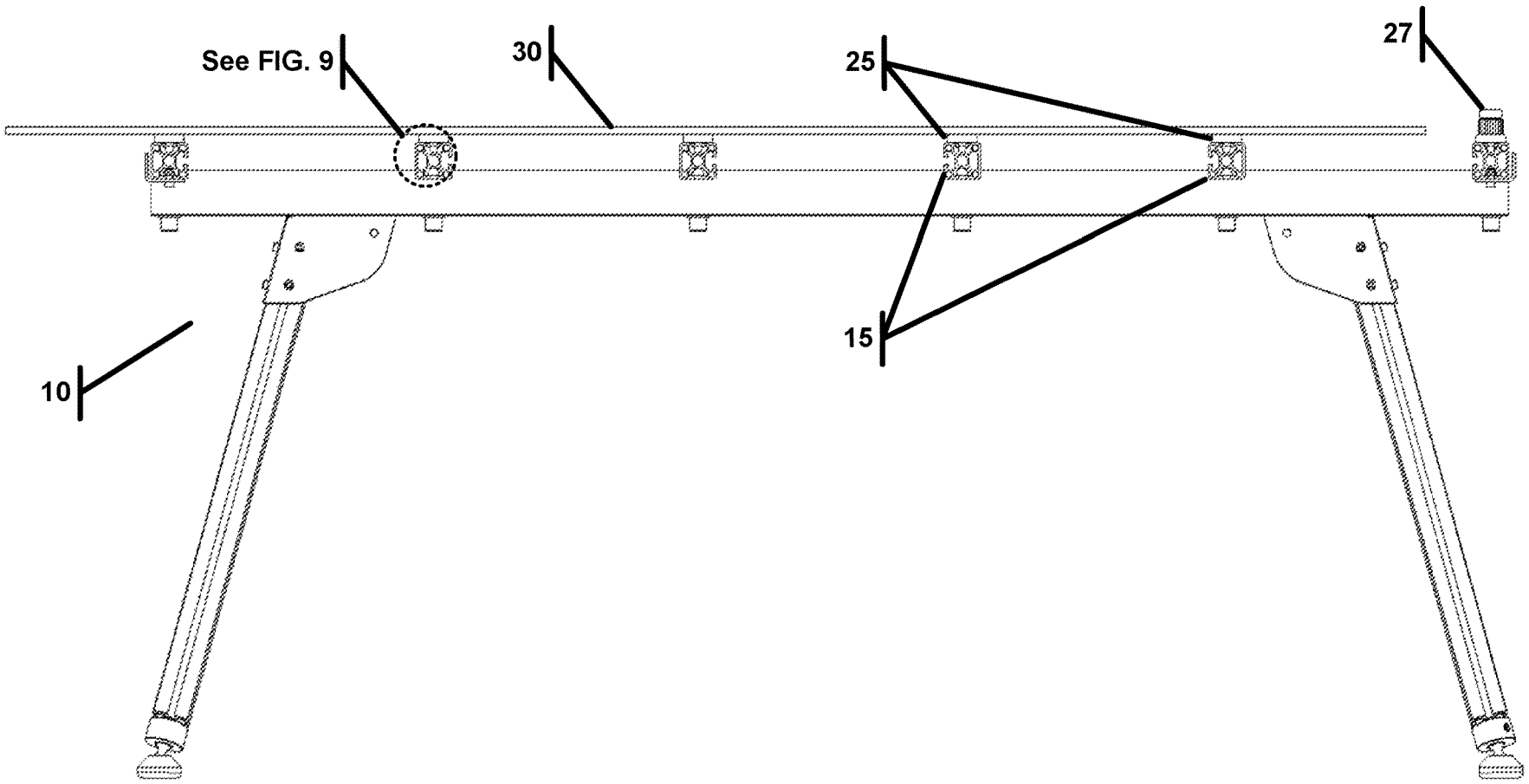
FIG. 8 is a side view of a multi-rail work table with the channel pucks installed, supporting a work piece.
Figure 9:
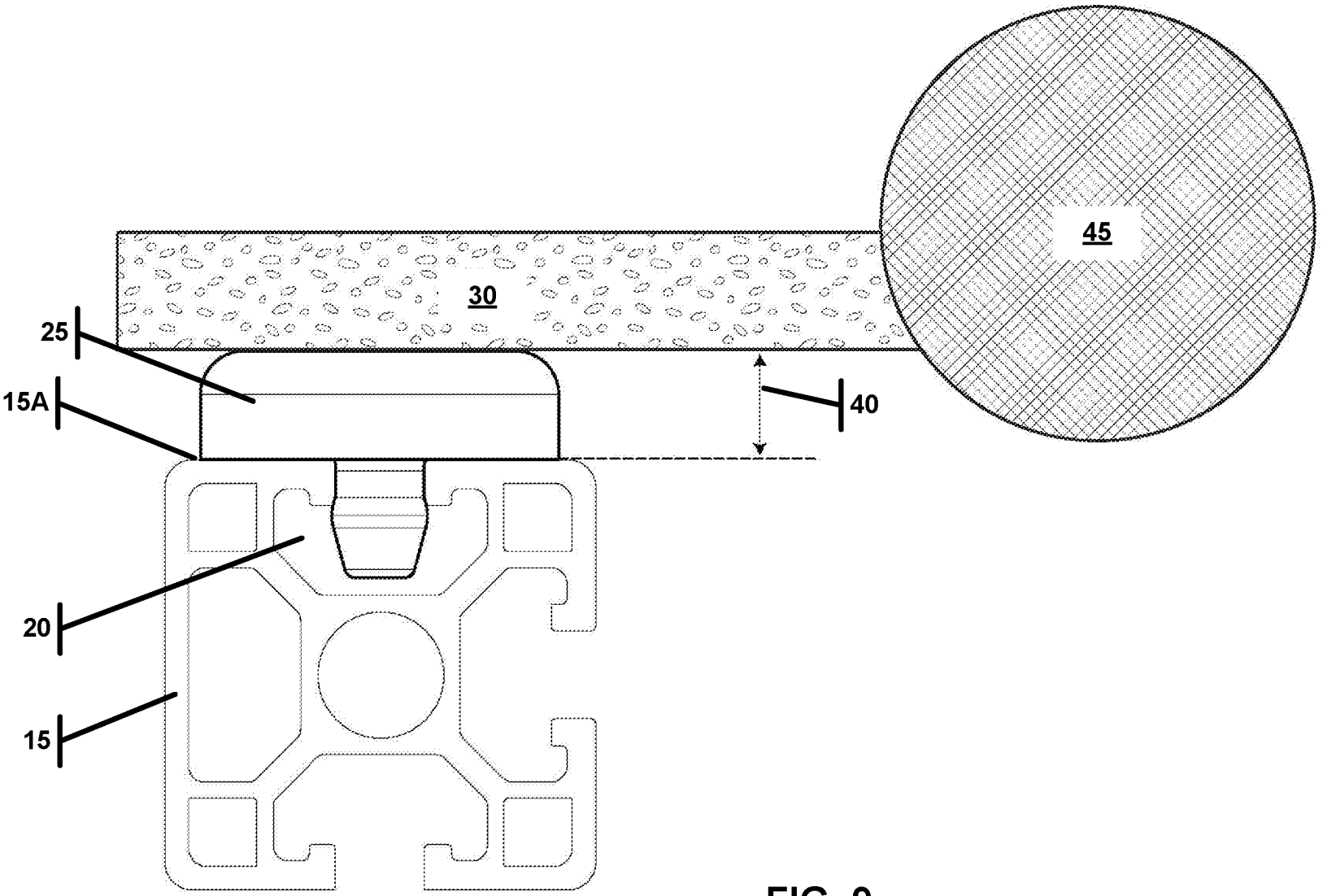
FIG. 9 is a cross-sectional view of a single rail with a channel puck installed, supporting a work piece.

FIGS. 8 and 9 illustrate the offset 40 away from the metal rail 15 that the channel puck 25 provides. This offset 40 aids a user when fabricating a work piece on-site. Referencing FIG. 9, a user may set a power tool 45 (such as a drill, saw, or grinder) to have a depth past the bottom edge of the work piece that is less than the offset 40; thereby avoiding cutting the metal rails that damages the power tool and the work table.

The semi-compressible puck material also provides vibration mitigation that prevents unintended work piece damage. Specifically, when fabricating a work piece on the work table, a user will often use power tools. Vibrations from these tools can sometimes cause the work piece material to crack because in the absence of the channel puck, the material is vibrating against a hard metal surface on a typical table. The presently disclosed channel pucks dampen the vibrations, mitigating possible work piece damage.

In addition, the channel puck material is softer than metal and can easily be cut, if the power tools were to inadvertently contact the channel puck. A user fabricating a work piece on a typical table without the channel pucks might hit a metal rail when cutting. Not only will this possibly damage the power tool and the work table, it may interfere (possibly irreversibly) with the intended cut to the work piece. A user working on a work table with the channel pucks disclosed herein can set the power tool is exit the material at a depth that is less than the offset 40 (see FIG. 9) and actually cut through the channel puck without the channel puck offering significant resistance. This protects the power tool from damage, and does not interfere with the intended cut. If the cut channel puck is excessively damages, it can be popped out, and a new one can be pushed into the same location, if needed.

Figure 10A:
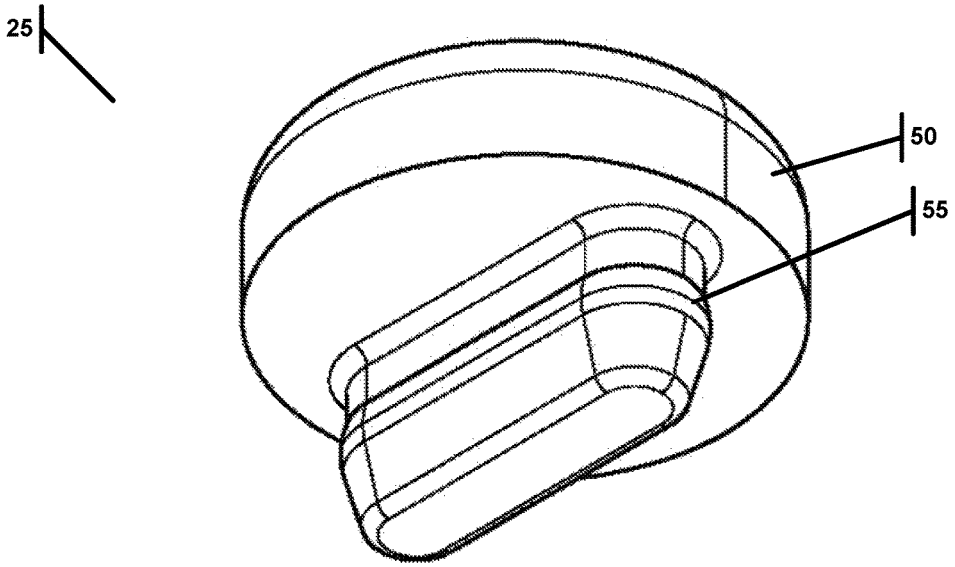
FIG. 10A is a bottom perspective view of a channel puck.

The specific shape of the channel puck 25 is shown in detail in FIG. 10A. The channel puck 25 has a puck top 50 and a puck tongue 55. The puck top 50 has a top surface 50A that contacts the work piece. While the channel puck 25 shape is shown as circular, other shapes would be apparent to a person of skill in the art. The puck tongue 55 is specifically shaped to insert into the rail channel 20, and to abut the rail channel 15 to minimize the channel puck 25 from sliding within the rail channel 20. The puck tongue 55 may be comprised of three regions: a necked region 60, a flared region 65 and a tapered region 70. Each of these regions is designed for an easy and secure installation into the rail channel 20.

Figure 11A:
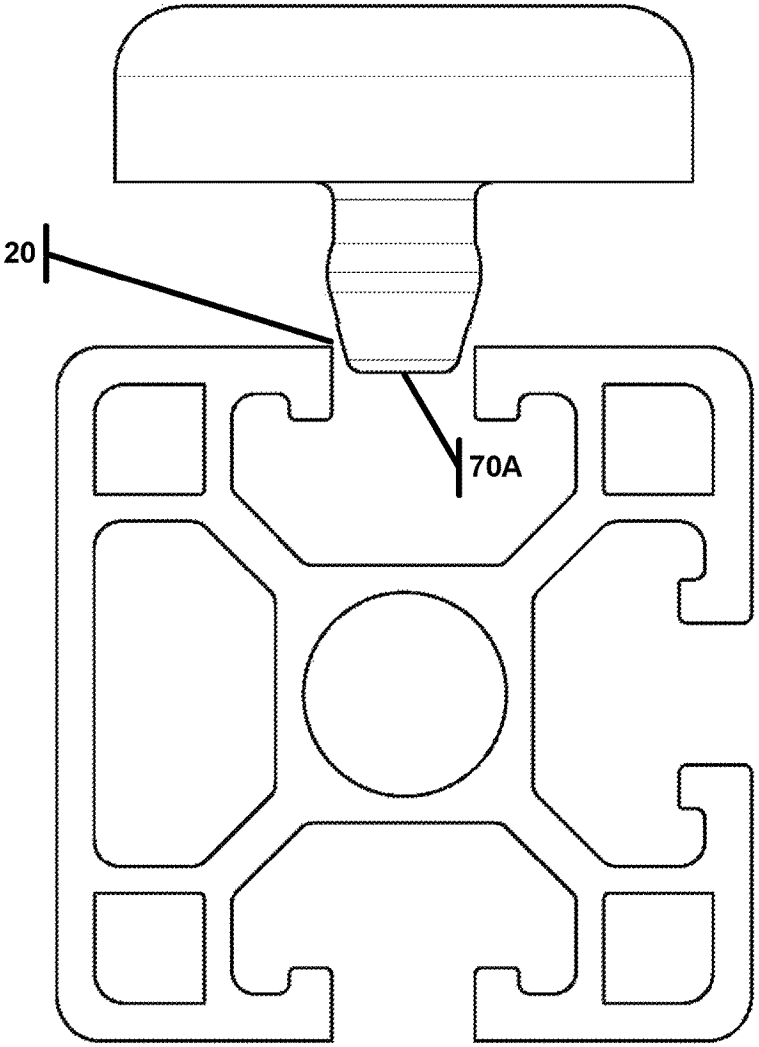
FIG. 11A is a cross-sectional view of a single rail with a channel puck in a locating configuration.
Figure 11B:
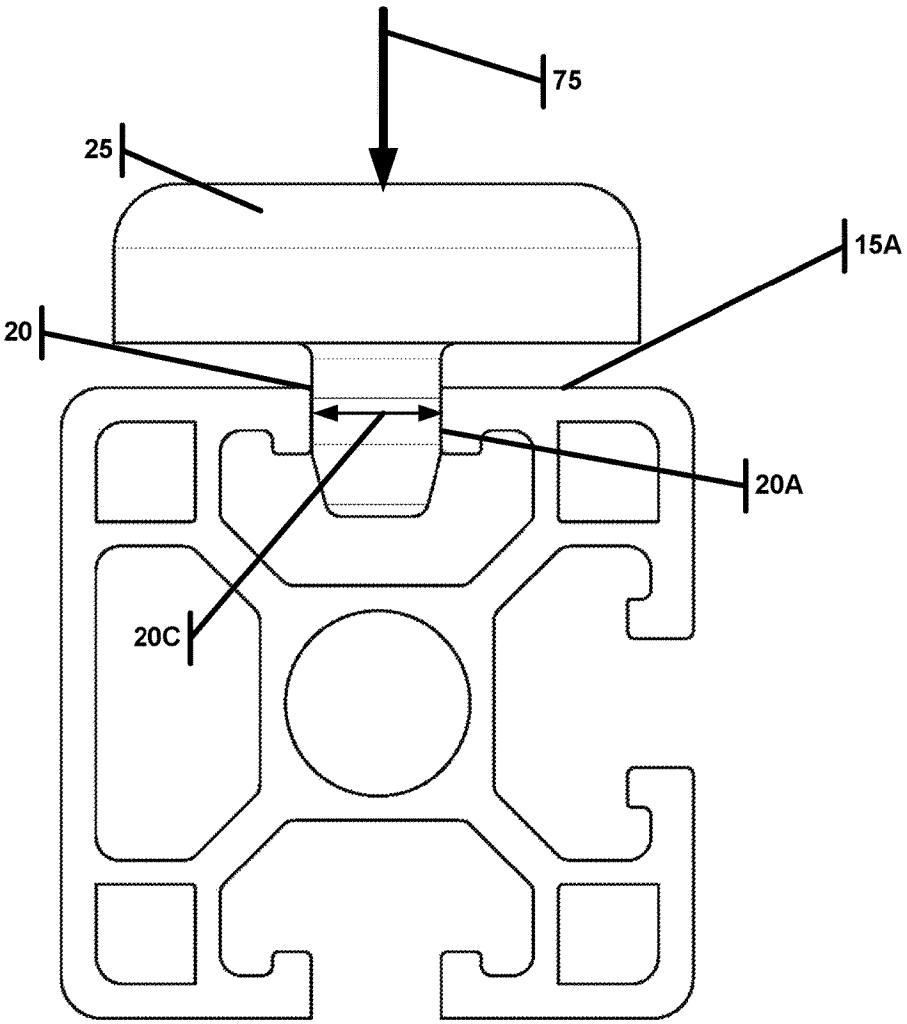
FIG. 11B is a cross-sectional view of a single rail with a channel puck in an active installation configuration.
Figure 11C:
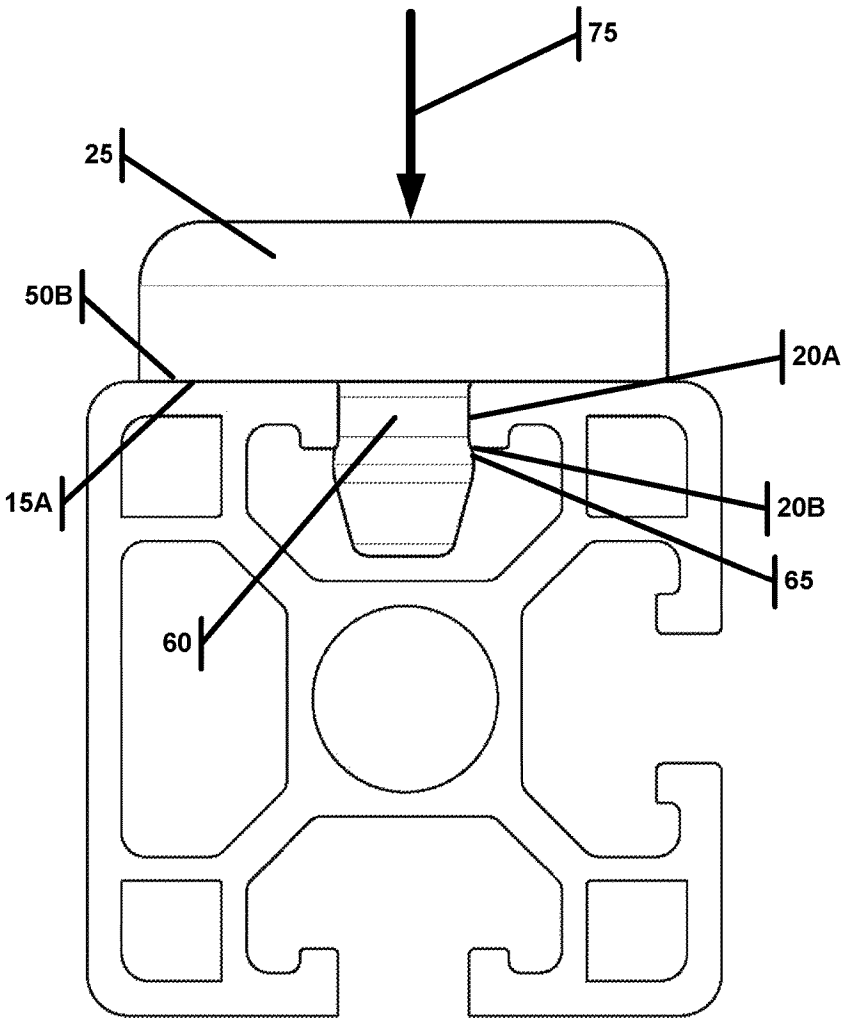
FIG. 11C is a cross-sectional view of a single rail with a channel puck in a passive installation configuration.

Installation of the channel puck 25 is shown in three configurations in FIGS. 11A-11C. The locating configuration is shown in FIG. 11A. The narrowed end 70A of the tapered region 70 is located partially in the rail channel 20. A user can easily locate the channel puck 25 anywhere along the rail channel before beginning the active installation configuration shown in FIG. 11B. The user pushes the channel puck 25 in in the direction of arrow 75 into the rail channel 20 (substantially orthogonal to the plane defined by the table rail top surface 15A), causing the flared region 65 to compress as it pushes past the rail channel side edges 20A. Once the flared region 65 passes the rail channel side edges 20A, the channel puck is in the passive installation configuration shown in FIG. 11C. The flared region 65 decompresses relative to the active installation configuration and abuts the rail channel bottom edges 20B, and the necked region 60 may abut the rail channel side edges 20A. Because the channel puck 25 is made of a soft semi-compressible material, such as rubber or soft plastic, once the channel puck 25 is in the passive installation configuration, it does not freely slide within the channel rail 20. But it does slide enough to allow the user to more fine adjust the position of the channel puck 25 within the channel rail 20. However, once a work piece is placed on the channel puck 25, the weight of the work piece causes the bottom surface of the puck top 50B to firmly contact the top rail surface 15A, adding to the frictional force that more strongly resists sliding, allowing the user to fabricate the work piece without unintended sliding.

Figure 10B:
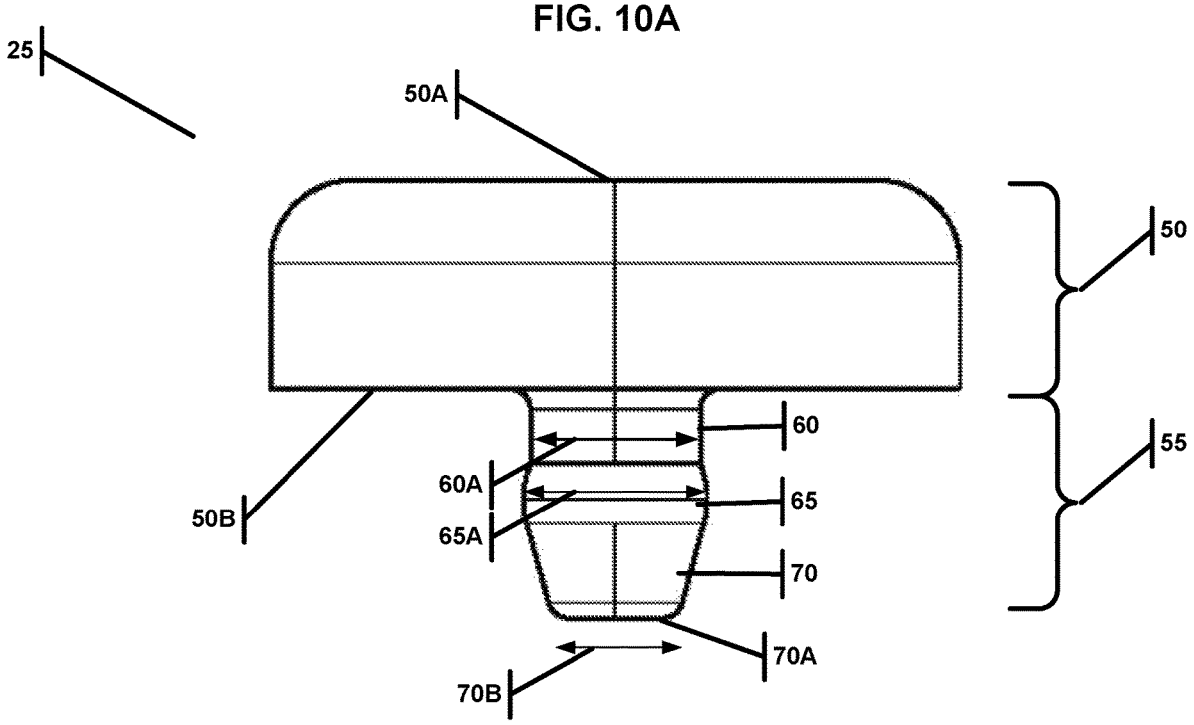
FIG. 10B is a side view of a channel puck.

FIG. 10B illustrates the various widths of the channel puck 25. The width of the necked region 60A is preferably about the same width or slightly wider than the rail channel opening width 20C (see FIG. 11B). The width of the necked region 65A is wider than the necked region and wider than the rail channel opening width 20C. The width 70B of the narrowed end 70A is narrower than that of the necked region 65A and narrower than the rail channel opening width 20C to allow the narrowed end 70A to be inserted partially into the rail channel 20 without the need to press the channel puck 25 into the channel rail 20.

Figure 12:
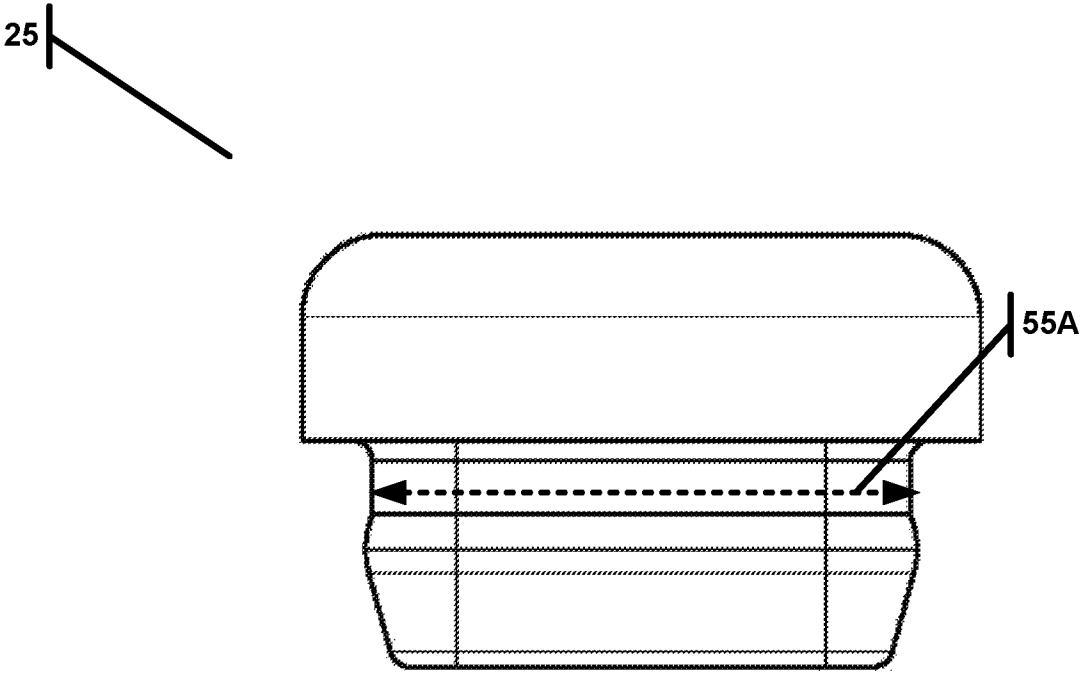
FIG. 12 is a side view of a channel puck.
Figure 13:
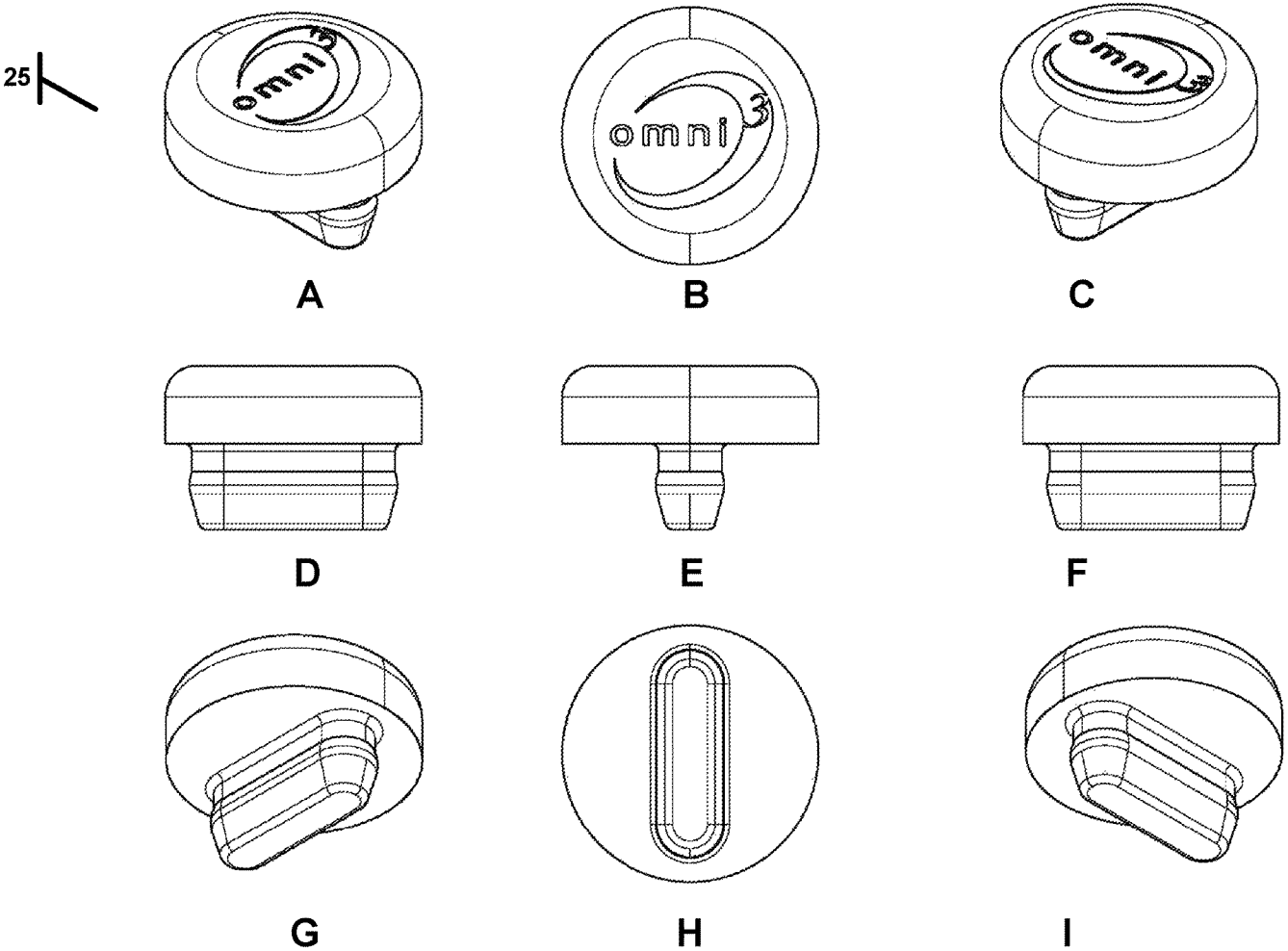
FIG. 13A is a top right perspective view of a channel puck.
FIG. 13B is a top view of a channel puck.
FIG. 13C is a top left perspective view of a channel puck.
FIG. 13D is a left side view of a channel puck.
FIG. 13E is a front side view of a channel puck.
FIG. 13F is a right side view of a channel puck.
FIG. 13G is a bottom right perspective view of a channel puck.
FIG. 13H is a bottom view of a channel puck.
FIG. 13I is a bottom left perspective view of a channel puck.
Figure 14A:
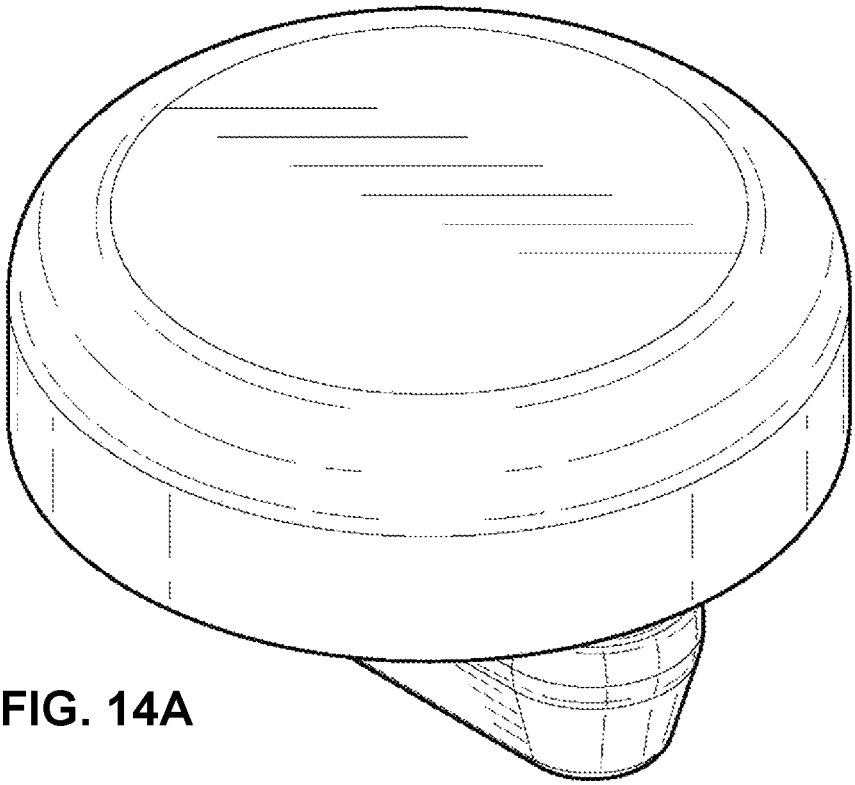
FIG. 14A is a top perspective view of a channel puck.
Figure 14B:
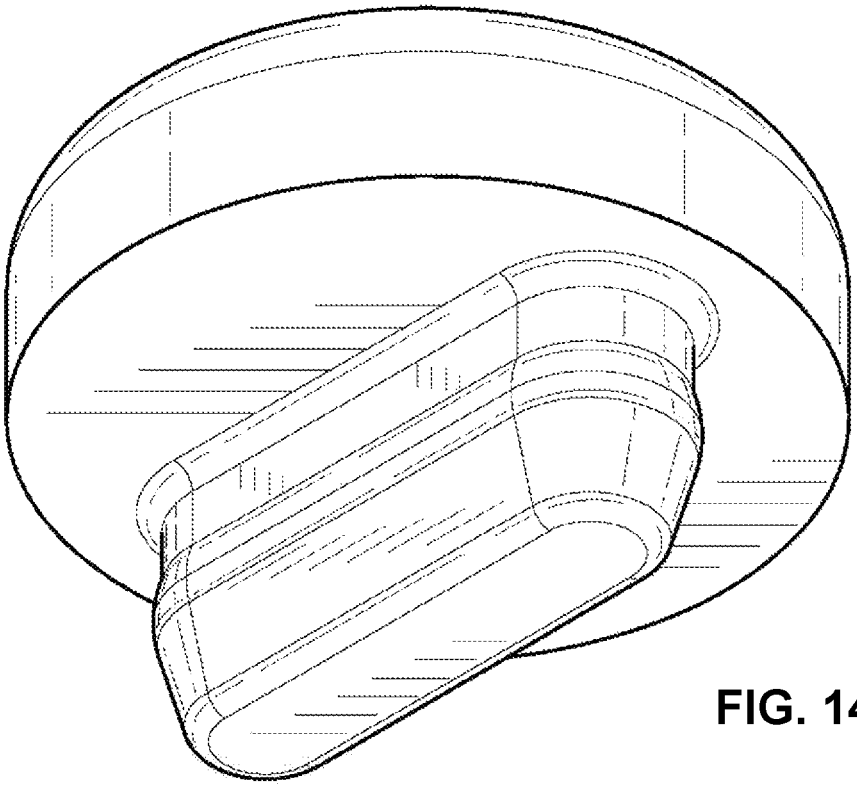
FIG. 14B is a bottom perspective view of a channel puck.
Figure 14C:
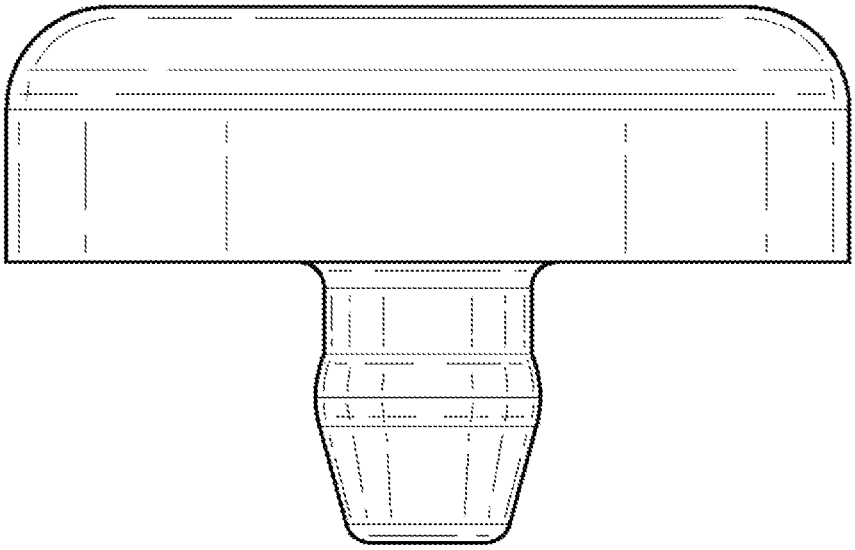
FIG. 14C is a front side view of a channel puck.
Figure 14D:
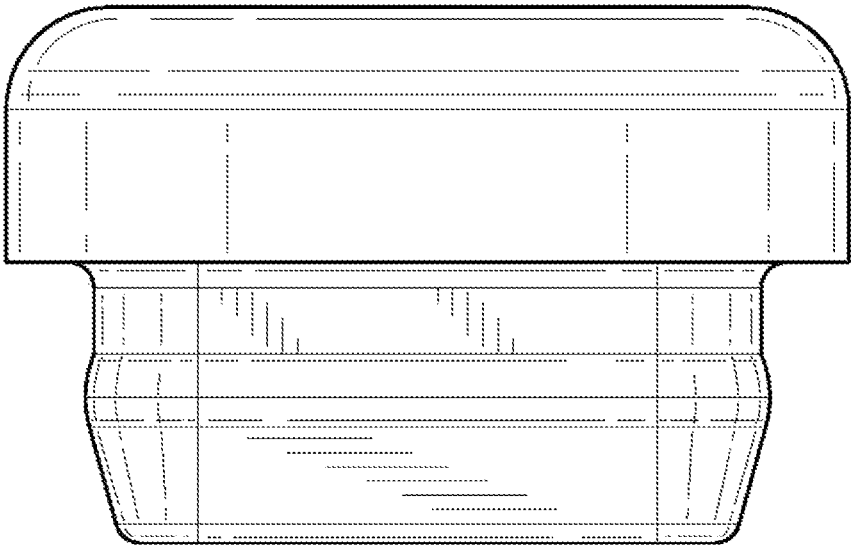
FIG. 14D is a left side view of a channel puck.
Figure 14F:
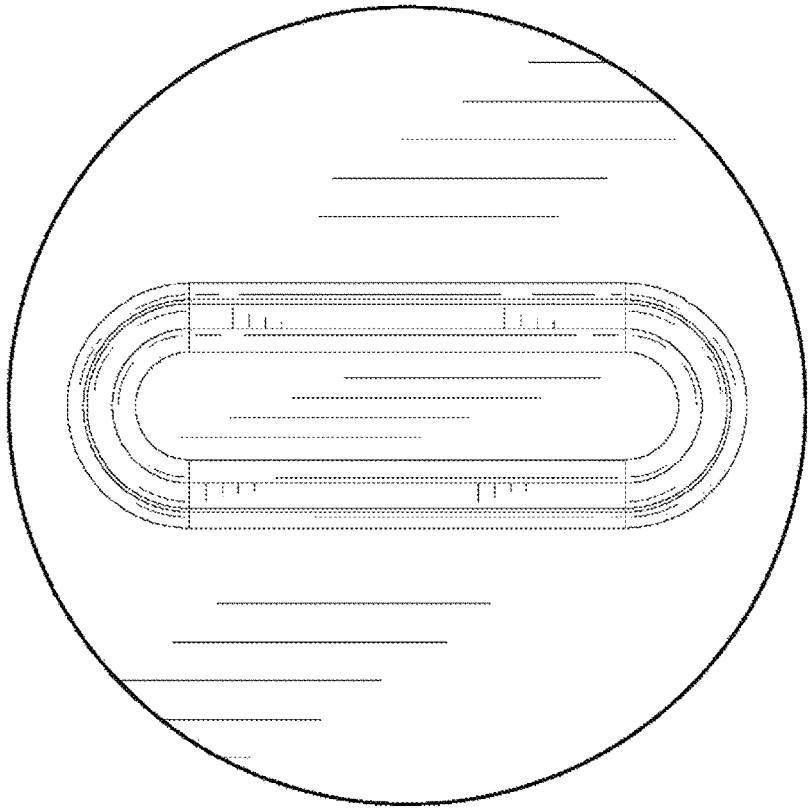
FIG. 14F is a bottom view of a channel puck.
Figure 14E:
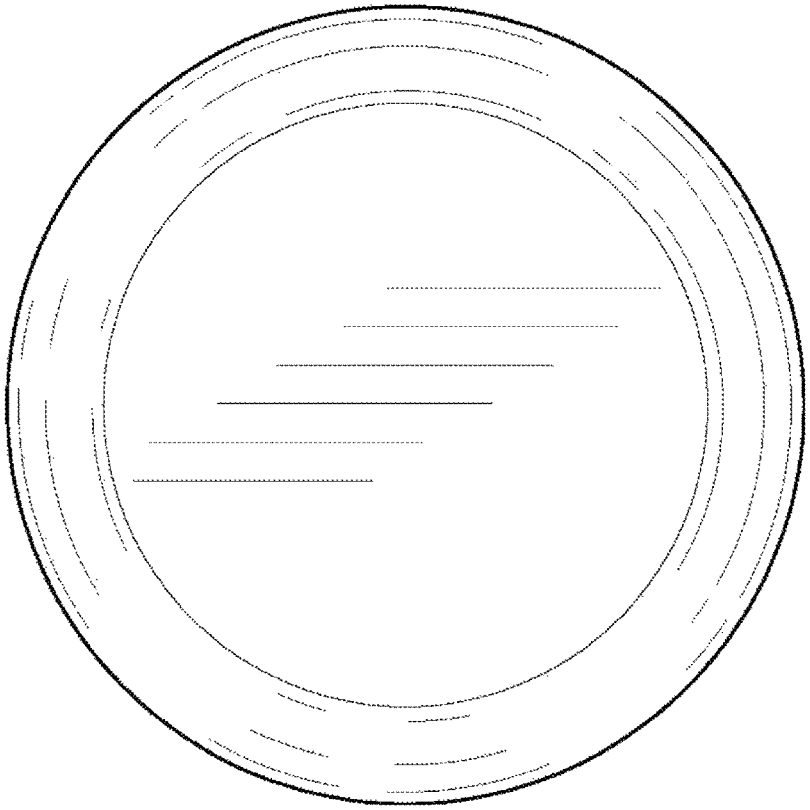
FIG. 14E is a top view of a channel puck.

FIG. 12 illustrates a side view of the channel puck 25. The tongue longitudinal dimension (preferably taken along the necked region) is shown as arrow 55A. This dimension 55A is preferably longer than the rail channel opening width 20C, to prevent the channel puck 25 from rotating while in the passive installation configuration.

FIGS. 13A-131 and 14A-14F are various views of the channel puck 25.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently-preferred embodiment of the invention and are therefore representative of the subject matter which is broadly contemplated by the present invention. It is further understood that the scope of the present invention fully encompasses other embodiments that may become obvious to those skilled in the art, and that the scope of the present invention is accordingly limited by nothing other than the appended claims.

The invention claimed is:

1. A work table for use in solid surface fabrication and installation of a work piece, the work table comprising:

a plurality of table rails wherein each table rail has a rail top surface and a rail channel running along at least a portion of the rail length on the rail top surface;

a plurality of channel pucks comprised of a compressible material, each in the plurality comprising;

a puck top and a puck tongue, the puck tongue comprising;

a necked region;

a flared region; and a tapered region;

wherein the puck tongue in each in the plurality of pucks is adapted to be inserted into the rail channel in a direction that is substantially orthogonal to the rail top surface.

2. The work table of claim 1, wherein each rail channel comprising a side edge and a bottom edge, and wherein each in the plurality of the channel pucks has at least three configurations relative to the rail channel:

a locating configuration, wherein the tapered region is at least partially in the rail channel;

an active installation configuration, wherein the flared region compresses against the rail side edge; and a passive installation configuration, wherein (1) the flared region is decompressed relative to the active installation configuration, (2) the flared region abuts the rail bottom edge, and (3) the puck top abuts the rail top surface.

3. The work table of claim 2, wherein the puck top comprises a puck top surface constructed to contact the work piece and wherein in the passive installation configuration the puck top surface is elevated away from the rail top surface by an offset.

4. The work table of claim 1, wherein the compressible material is a soft plastic or rubber.

5. The work table of claim 1, wherein the rail channel has a rail channel opening width, and the puck tongue has a longitudinal dimension, wherein the rail channel opening width is narrower than the longitudinal dimension.

6. The work table of claim 1, wherein the necked region is narrower than the flared region.

7. The work table of claim 6, wherein the tapered region comprises a narrowed end that is narrower than the necked region.

8. The work table of claim 1, wherein the rail channel has a rail channel opening width that is narrower than the flared region.

9. The work table of claim 1, wherein the compressible material is slip resistant.

10. The work table of claim 1, wherein the puck top comprises a puck top surface constructed to contact the work piece.

11. A channel puck to be used in a work table with at least one table rail, the table rail having a rail top surface and a rail channel running along at least a portion of the rail length on the rail top surface, the channel puck comprising:

a puck top and a puck tongue, the puck tongue comprising;

a necked region;

a flared region; and a tapered region;

wherein the puck tongue is adapted to be inserted into the rail channel in a direction that is substantially orthogonal to the rail top surface; and wherein the channel puck is comprised of a compressible material.

12. The channel puck of claim 11, wherein the rail channel comprising a side edge and a bottom edge, and wherein the channel puck has at least three configurations relative to the rail channel:

a locating configuration, wherein the tapered region is at least partially in the rail channel;

an active installation configuration, wherein the flared region compresses against the rail side edge; and a passive installation configuration, wherein (1) the flared region is decompressed relative to the active installation configuration, (2) the flared region abuts the rail bottom edge, and (3) the puck top abuts the rail top surface.

13. The channel puck of claim 12, wherein the puck top comprises a puck top surface constructed to contact a work piece, and wherein in the passive installation configuration, the puck top surface is elevated away from the rail top surface by an offset.

14. The channel puck of claim 11, wherein the compressible material is a soft plastic or rubber.

15. The channel puck of claim 11, wherein the rail channel has a rail channel opening width, and the puck tongue has a longitudinal dimension, wherein the rail channel opening width is narrower than the longitudinal dimension.

16. The channel puck of claim 11, wherein the necked region is narrower than the flared region.

17. The channel puck of claim 16, wherein the tapered region comprises a narrowed end that is narrower than the necked region.

18. The channel puck of claim 11, wherein the rail channel has a rail channel opening width that is narrower than the flared region.

19. The channel puck of claim 11, wherein the compressible material is slip resistant.

20. The channel puck of claim 11, wherein the puck top comprises a puck top surface constructed to contact a work piece.

* * * * *